US005250997A

United States Patent [19]

Kaneko et al.

[11] Patent Number: 5,250,997

[45] Date of Patent: Oct. 5, 1993

[54] FINE PARTICLE RECOVERY DEVICE FOR RECOVERING PARTICLES, SUCH AS TONER, FROM A PLURALITY OF LOCATIONS

[75] Inventors: Hidetoshi Kaneko, Nara; Takashi Kubo, Yamatokoriyama; Yasutoshi Kawai, Yamatokoriyama; Koichi Moriyama, Yamatokoriyama, all of Japan

[73] Assignee: Sharp Kabushiki Kaisha, Osaka, Japan

[21] Appl. No.: 869,969

[22] Filed: Apr. 17, 1992

[30] Foreign Application Priority Data

Apr. 18, 1991 [JP] Japan ..... 3-86509
Mar. 6, 1992 [JP] Japan ..... 4-49660

[51] Int. Cl.[5] ..... G03G 21/00
[52] U.S. Cl. ..... 355/298
[58] Field of Search ..... 355/215, 298; 118/652

[56] References Cited

U.S. PATENT DOCUMENTS 4,154,521 5/1979 Tanaka ..... 355/215
4,165,171 8/1979 Lemmen ..... 355/296
4,297,021 10/1981 Tani et al. ..... 355/298
4,941,022 7/1990 Ohmura et al. ..... 355/298
5,028,959 7/1991 Gooray ..... 355/215

FOREIGN PATENT DOCUMENTS 63-23181 1/1988 Japan .
1-144088 6/1989 Japan ..... 355/298

*Primary Examiner*—Fred L. Braun

[57] ABSTRACT

A fine particle recovery device for recovering fine particles such as waste toner accumulating at a plurality of locations such as a photoreceptor and a transferring belt in an image forming apparatus. The fine particle recovery device possesses transport path, constituted by waste toner recovery pipes, which allows the waste toner from the plurality of locations to pass therethrough; a waste toner recovery container, attached to the exit of the transport path, which stores the waste toner in one lot; and auger axes, installed inside the transport path, which convey the waste toner toward the waste toner recovery container. Further, among transport distances from the respective locations to the waste toner recovery container, the transport distance from the location having the most waste toner to the waste toner recovery container is set to be the shortest.

17 Claims, 4 Drawing Sheets

FINE PARTICLE RECOVERY DEVICE FOR RECOVERING PARTICLES, SUCH AS TONER, FROM A PLURALITY OF LOCATIONS

FIELD OF THE INVENTION

The present invention relates to a fine particle recovery device for use in an image forming apparatus for transferring toner images onto sheets of copy paper. This device recovers fine particles such as residual toner and developer that accumulate at a plurality of locations in the image forming apparatus.

BACKGROUND OF THE INVENTION

As shown in FIG. 4, in a conventional full color copying machine provided with a residual toner recovery device as one type of fine particle recovery devices, a yellow-developer tank 102, a Magenta-developer tank 103, a cyan-developer tank 104 and a black-developer tank 105 are closely installed in this order from the upstream side of a photoreceptor belt 101 within its movable area indicated by an arrow A in the drawing. When a color copying operation is executed, an original document (not shown) placed on a document platen glass 113 is first scanned three times by an optical system 106. In each of the scans, a reflected light beam from the original document is directed through a color separation filter onto the photoreceptor belt 101 for slit-exposure, and thus electrostatic latent images are formed, which have respective complementary colors to yellow, Magenta and cyan toners. Every time each of those electrostatic latent images is formed, yellow toner, Magenta toner or cyan toner is independently supplied onto the photoreceptor belt 101 from the yellow-toner developer tank 102, Magenta-toner developer tank 103 or cyan-toner developer tank 104 in this order. Thereafter, toner images, which are derived from those latent images subjected to the toner of respective colors, are superposed onto a transferring belt 107 that is pressed onto the photoreceptor belt 101.

After the superposing process has been finished, a sheet of copy paper (not shown) is fed to a predetermined position on a transferring roller 109 from a feeding cassette 108, and a toner image is thus transferred onto the copy paper by the transferring roller 109. The copy paper subjected to the transferring process is fixed by heat treatment in a fixing device 114 and then ejected from the copying machine main body. In the case of black-and-white copying process, only the black toner stored in the black-toner developer tank 105 is used and, after a black toner image has been formed on the photoreceptor belt 101, the same processes as those in full-color copying are conducted.

In the copying machine, as described above, the photoreceptor belt 101, the transferring belt 107 and the transferring roller 109, to which toner adheres, are respectively provided with cleaning sections 110 to 112 for scraping the residual toner off therefrom. These cleaning sections 110 to 112 have respective waste toner trays 110*a* to 112*a* for storing fine particles of the waste toner that has been scraped off, and this waste toner is then recovered in maintenance.

However, in the arrangement of the conventional waste toner recovery device, the following problems have been presented: Time-consuming maintenance work is required in recovering the waste toner since the three sections of the photoreceptor belt 101, the transferring belt 107 and the transferring roller 109 are individually taken care of. In the conventional waste toner recovery device, the waste toner trays 110*a* to 112*a* are attached to the front of the copying machine so as to make the waste toner recovery easier; thus, the bulky waste toner trays 110*a* and 111*a* restrict access to the front of the copying machine. Therefore, when locations other than the waste toner trays 110*a* and 111*a* are to be maintained, the waste toner trays 110*a* and 111*a* tend to interfere with the maintenance work such that the efficiency of the work is deteriorated. If any one of the waste toner trays 110*a* to 112*a*, which are individually attached to three places, reaches the maximum storage limit, the machine needs to be shut down and the waste toner needs to be recovered even if other waste toner trays still have some room for storage; this results in low efficiency of the waste toner recovery.

On the other hand, Japanese Laid-Open Patent Application No. 23181/1988 (Tokukaisho 63-23181) discloses a copying machine provided with a fine particle recovery device which has a plurality of storing sections for storing developer, a recovery container for recovering used developer, which is placed under these storing sections, recovery pipes for connecting each of the storing sections to the recovery container, conveying members for conveying developer at the storing sections toward the respective recovery pipes. In this copying machine, after the developer in each of the storing sections has been used up, the spent developer is transferred to the recovery pipe by the conveying member, and then falls by gravity through the recovery pipe into one section (the recovery container) to be collected therein. Thus, this system makes it easier to handle the spent developer.

By adopting the above fine particle recovery device into the aforementioned waste toner recovery of the copying machine, waste toner accumulating at each section is collected into one place by means of the conveying member and the recovery pipe; therefore, the above problems can be solved. However, in this case, the waste toner is collected into the recovery container by letting it fall by gravity; therefore, the mounting place of the recovery container is limited to somewhere below the places where the waste toner accumulates. Since the mounting place is not freely selected, the efficiency of the maintenance work is not fully improved. Additionally, the mounting place for the recovered spent developer is also limited.

SUMMARY OF THE INVENTION

It is an object of the present invention to provide a fine particle recovery device which collects fine particles such as waste toner that accumulates at a plurality of locations in an image forming apparatus into one section such that the fine particles are effectively recovered and the efficiency of the maintenance work is fully improved.

In order to achieve the above objects, the fine particle recovery device of the present invention is provided with a transport path means for conveying fine particles from a plurality of locations so as to recover the fine particles accumulating at the plurality of the locations in an image forming apparatus; and a recovery means for storing the fine particles in one lot, which is attached to the exit of the transport path means; a conveying means for conveying the fine particles to the recovery means, which is installed in the transport path means.

With the above arrangement, fine particles accumulating at a plurality of locations in the image forming apparatus are delivered through the conveying means so as to be stored in the recovery means in one lot; thus the fine particles are efficiently recovered. Here, the transport path means is provided with the conveying means that permits the transport path means to forcibly transport the fine particles. Accordingly, compared with the system for recovering the fine particles into the recovery means by letting them fall by gravity, the mounting place of the recovery means can be more freely selected. This free selection makes it possible to install the recovery means at the best place, far away from the photoreceptor drum, etc. so as not to interfere with the maintenance work; thus, the efficiency of the maintenance work can be fully improved.

For a fuller understanding of the nature and advantages of the invention, reference should be made to the ensuing detailed description taken in conjunction with the accompanying drawings. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention.

BRIEF DESCRIPTION OF THE DRAWINGS

FIG. 1 is a schematic perspective view illustrating the inside of a copying machine having a waste toner recovery device as a fine particle recovery device.

FIG. 2 is an explanatory drawing that illustrates the structure of the waste toner recovery device.

FIG. 3 is a schematic side view of the copying machine.

DESCRIPTION OF THE EMBODIMENTS

Figure 1:
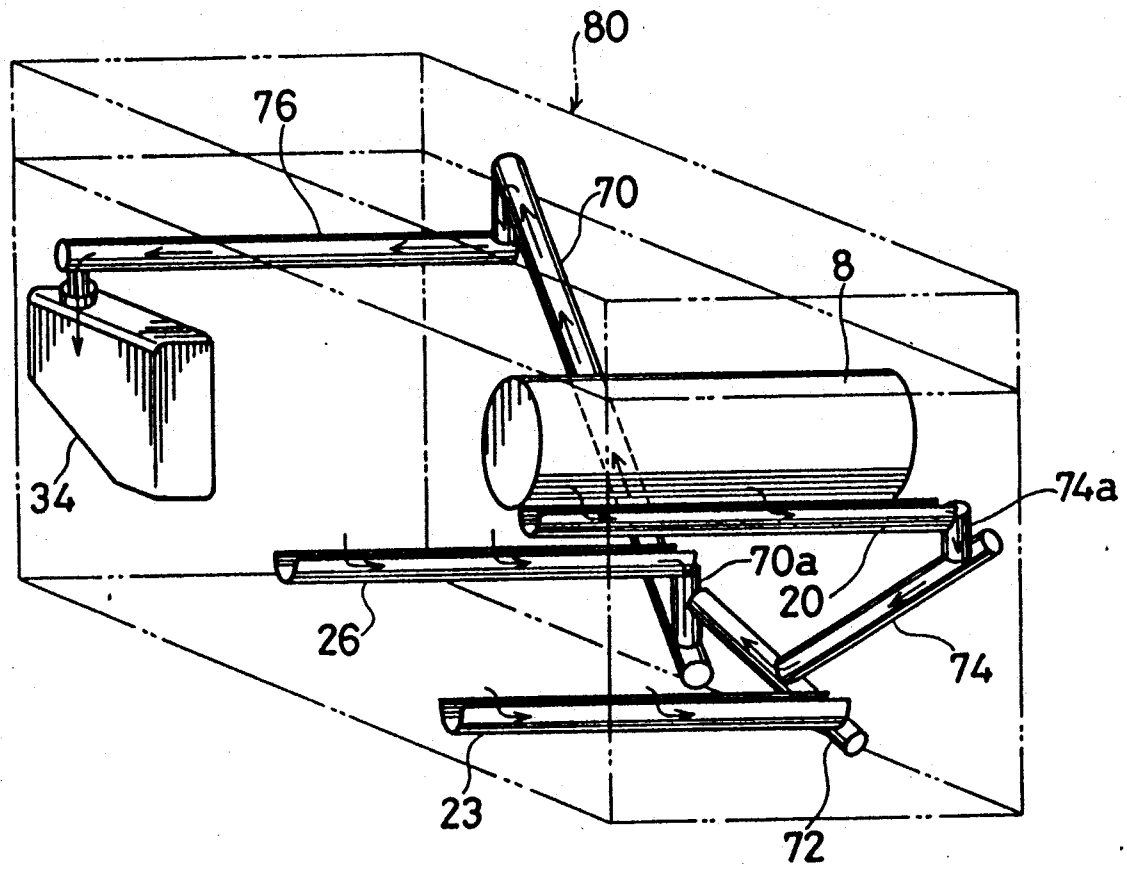
FIGS. 1 through 3 show one embodiment of the present invention.
Figure 2:
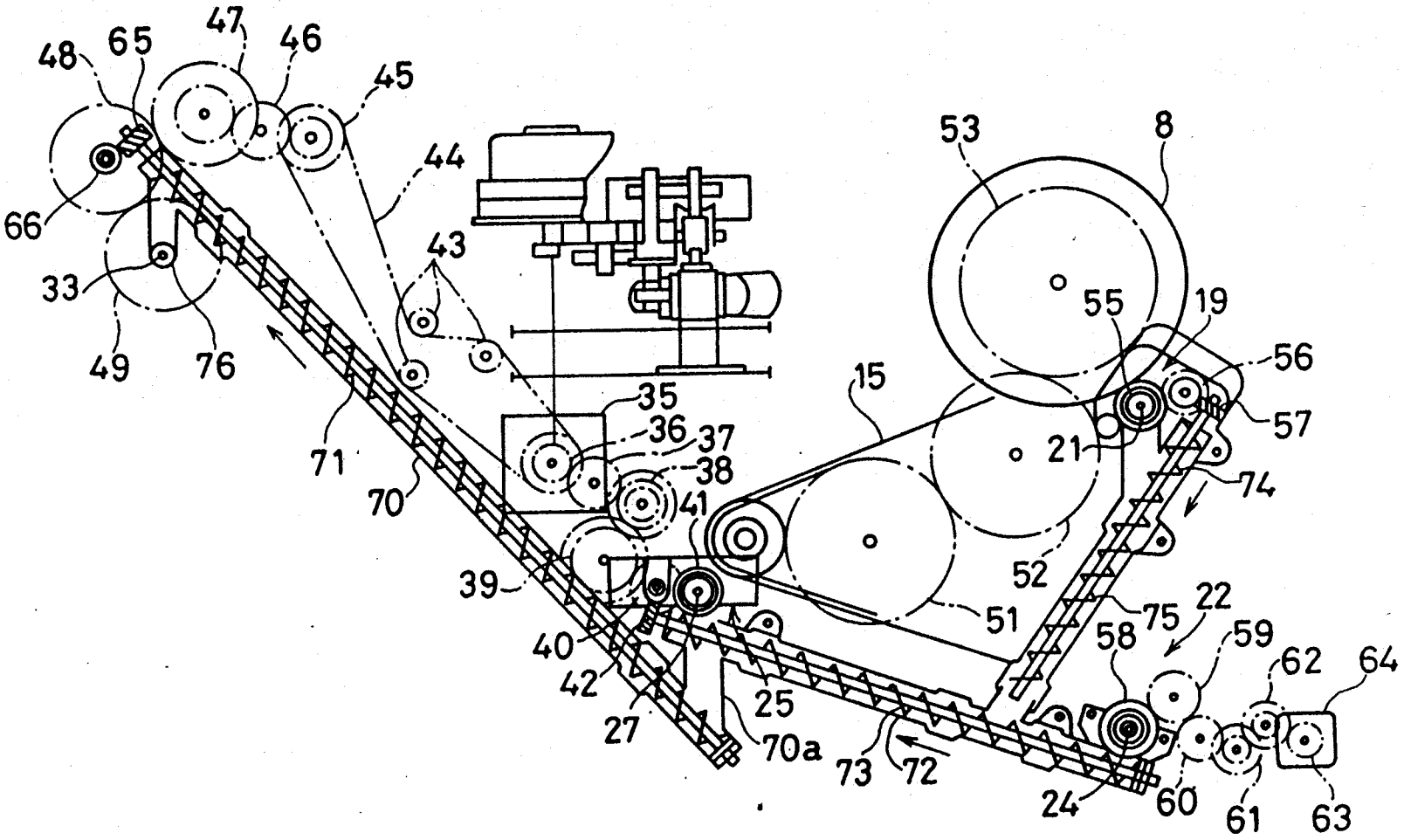
Figure 3:
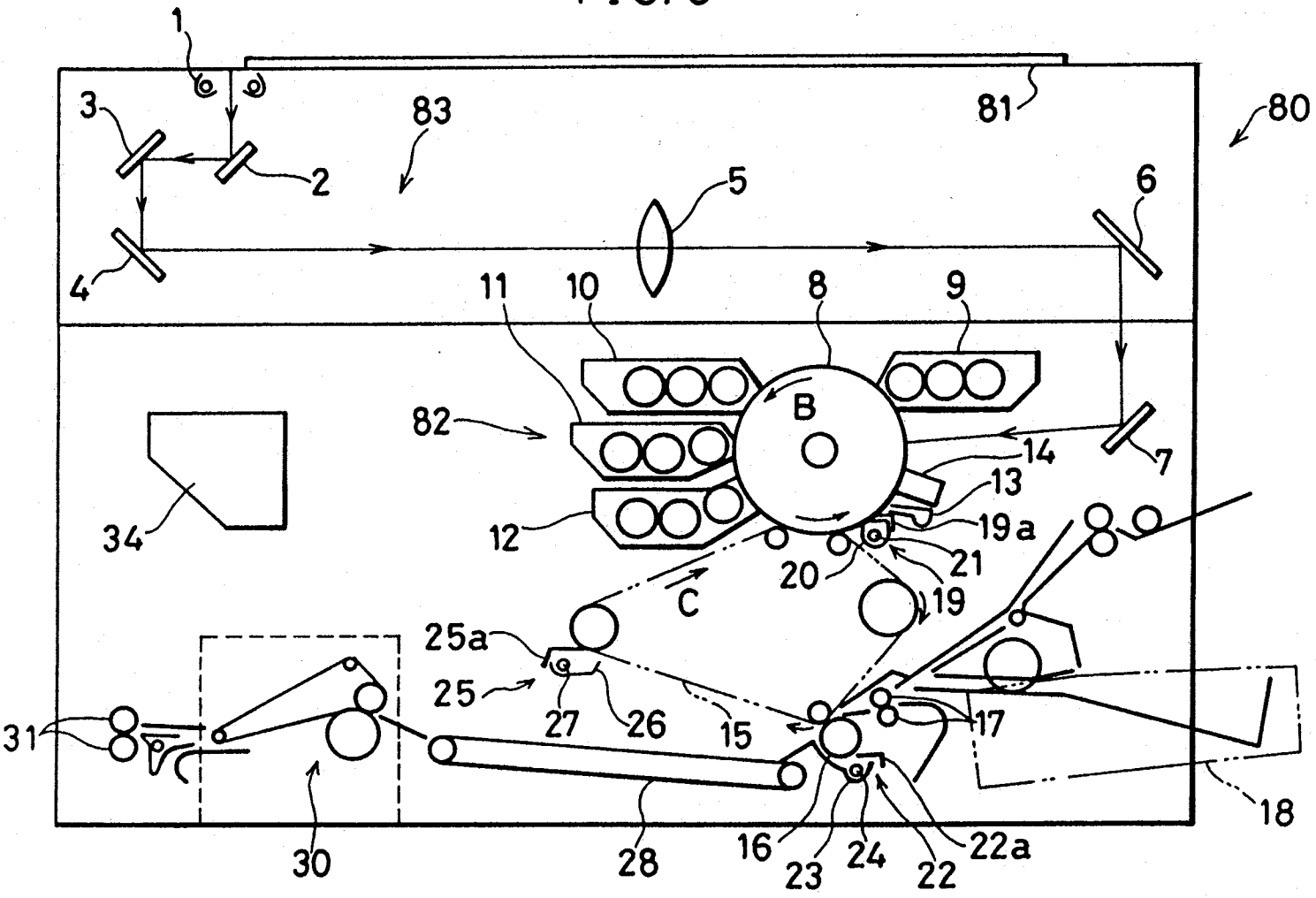
Figure 4:
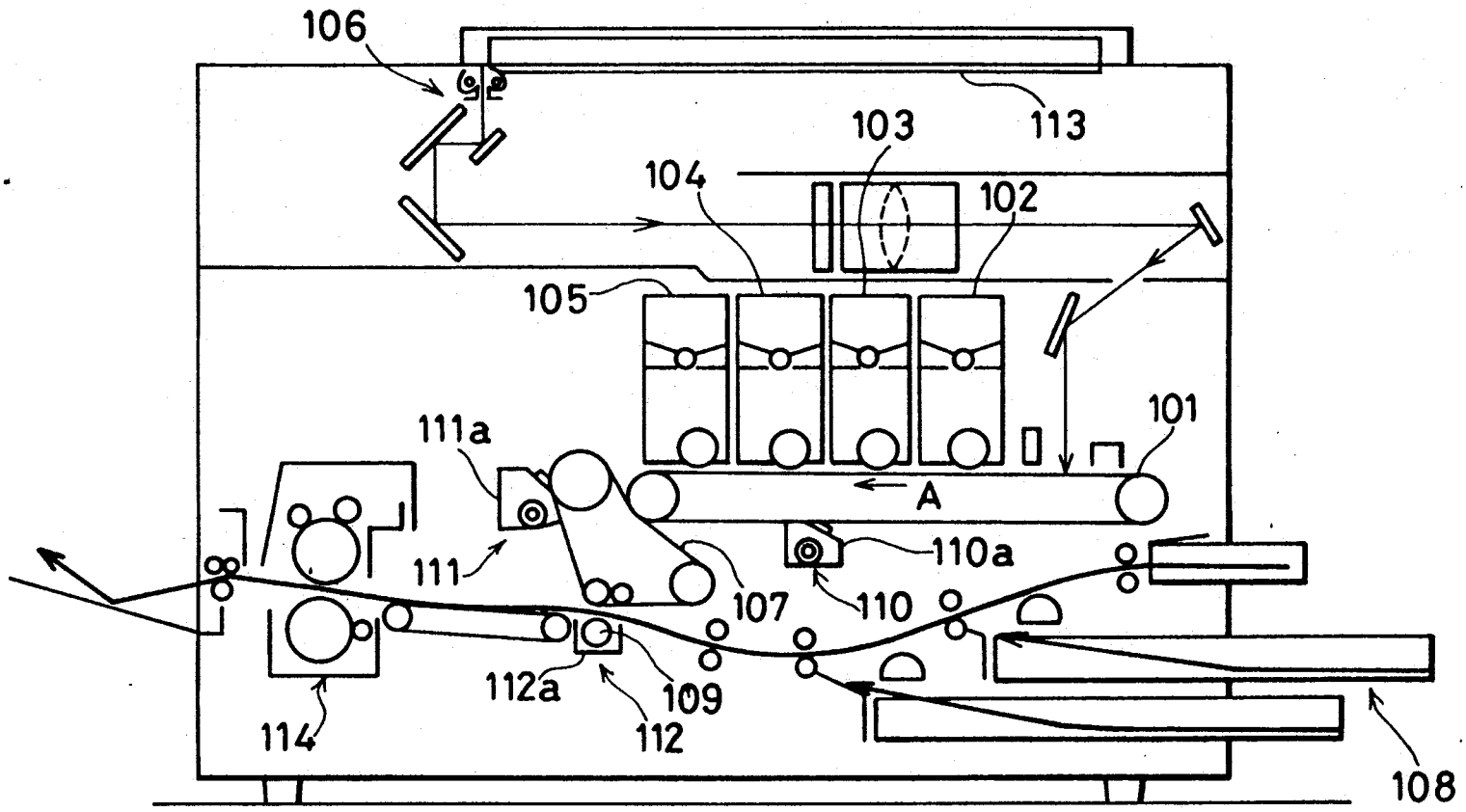
FIG. 4 PRIOR ART
FIG. 4, which shows the prior art, is a schematic side view of a copying machine having a waste toner recovery device.

Referring to FIGS. 1 through 3, the following description will discuss one embodiment of the present invention.

A fine particle recovery device of the embodiment of the present invention is used as a developer recovery device, a waste toner recovery device or other device that is provided in image forming apparatuses such as full color copying machines.

For example, FIG. 3 illustrates a full color copying machine provided with a waste toner recovery device. The full color copying machine is provided with a document platen 81 made of transparent hard glass, located on the upper surface of the copying machine main body 80. An original document (not shown) is placed on the document platen 81, and the original document is irradiated by a light beam from a lamp unit 1. The light beam reflected off from the original document is directed onto a photoreceptor drum 8, which is rotatable in a direction of an arrow B in FIG. 3, by way of mirrors 2, 3, 4, a lens unit 5, and mirrors 6 and 7. The lamp unit 1, the mirror 2 and other parts constitute a scanner 83.

At the vicinity of the photoreceptor drum 8, a main charger 14 is installed for uniformly charging the surface of the photoreceptor drum 8 prior to exposure. Thus, through the exposure, an electrostatic latent image is formed on the exposed area of the photoreceptor drum 8. Further, below the main charger 14, an eraser device for erasing a space between the images, not shown, a developing device 82, a transferring belt 15, a cleaning section 19 and an eraser lamp 13 are disposed in this order. The developing device 82 is constituted by a black developer tank 9, a yellow developer tank 10, a Magenta developer tank 11 and a cyan developer tank 12. The developer tanks 9 to 12 store respective toners having corresponding colors. The transferring belt 15 is an endless belt and is movable in a direction of an arrow C in FIG. 3.

A paper feed cassette 18 for housing sheets of copy paper is removably attached to the copying machine main body 80. Resist rollers 17 and a transferring roller 16 are disposed between the paper feed cassette 18 and the transferring belt 15 (on the paper feeding side). The resist rollers 17 are arranged to deliver one by one the sheets of copy paper, which are fed from the paper feed cassette 18, toward the transferring belt 15 with predetermined timing. The transferring roller 16 presses a sheet of copy paper onto the transferring belt 15 such that a toner image is transferred onto the sheet of copy paper.

On the other hand, at the paper discharging side, a conveyer belt 28, a fixing device 30 and paper discharge rollers 31 are installed in this order. The conveyer belt 28 conveys the sheet of copy paper, whereon the toner image has been transferred from the transferring belt 15 by the transferring roller 16, to the fixing device 30, where the toner image on the sheet of copy paper is subjected to heat treatment and fixed. Then, the paper discharge rollers 31 discharge the fixed sheet of copy paper out of the main body 80.

Moreover, the cleaning section 19, disposed in the periphery of the photoreceptor drum 8, is constituted by a cleaning blade **19*a*, a waste toner tray 20 and an auger axis (conveying member) 21. The auger axis 21 has a structure wherein a helical blade is formed around the axis. The cleaning section 19 is arranged such that: residual toner on the photoreceptor drum 8 is scraped off by the cleaning blade 19*a*; the waste toner that has been scraped off is received by the waste toner tray 20; and the waste toner stored in the waste toner tray 20 is conveyed therefrom in a direction of discharge by the auger axis 21**.

Furthermore, besides the cleaning section 19 disposed in the periphery of the photoreceptor drum 8, the copying machine 80 has another cleaning section 25 located within the moving area of the transferring belt 15 and the other cleaning section 22 located below the transferring roller 16. These cleaning sections 22 and 25 have the same structure as that of the above-mentioned cleaning section 19. More specifically, the cleaning section 22(25) is constituted by a cleaning blade **22*a*(25*a*), a waste toner tray 23(26) and an auger axis 24(27). Therefore, the cleaning section 22(25) is arranged such that: residual toner on the transferring roller 16 (the transferring belt 15) is scraped off by the cleaning blade 22*a*(25*a*); the waste toner that has been scraped off is received by the waste toner tray 23; and the waste toner stored in the waste toner tray 23(26) is conveyed therefrom in a direction of the discharge by the auger axis 24(27)**.

In the above arrangement, a color copying operation is executed through the following procedures: After the main charger 14 has uniformly charged the surface of the photoreceptor drum 8, the first scanning is conducted by the scanner 83. Then, the reflected light from the original document is directed through a color separation filter, not shown, onto the surface of the photoreceptor drum 8 for slit-exposure, which located between the main charger 14 and the eraser device for erasing a space between images, and thus a blue electrostatic latent image is formed on the exposed area.

Next, a portion of the electrostatic latent image corresponding to a non-image area is erased by the eraser device, and yellow toner from the yellow developer tank 10 is supplied onto the electrostatic latent image corresponding to the remaining image area, thereby making a toner image in the same color. The toner image, while being rotatively carried in a direction of the arrow C in FIG. 3, is transferred onto the transferring belt 15 which is in part pressed onto the photoreceptor drum 8. Thereafter, the eraser lamp 13 eliminates the residual charge from the surface of the photoreceptor drum 8.

Successively, after the main charger 14 has uniformly charged the surface of the photoreceptor drum 8 again, the second scanning is conducted. Then, the reflected light from the original document is directed onto the surface of the photoreceptor drum 8 for slit-exposure, and a green electrostatic latent image is thus formed thereon. Following the same procedures as the above, a non-image area is erased by the eraser device, and Magenta toner is supplied from the Magenta developer tank 11 to make a toner image in the same color. Thereafter, through the same processes as described above, the toner image is transferred from the photoreceptor 8 onto the transferring belt 15, and after the superposing process of the resulting two toner images, the eraser lamp 13 eliminates the residual charge from the surface of the photoreceptor drum 8.

Successively, after the main charger 14 has uniformly charged the surface of the photoreceptor drum 8 again, the third scanning is conducted. Then, the reflected light from the original document is directed onto the surface of the photoreceptor drum 8 for slit-exposure, and a red electrostatic latent image is thus formed thereon. Following the same procedures as the above, a non-image area is erased by the eraser device, and cyan toner is supplied from the cyan developer tank 12 to make a toner image in the same color. Then, the toner image is transferred from the photoreceptor 8 onto the transferring belt 15, and the final superposing process is conducted.

After having undergone the superposing process, the resulting toner image on the transferring belt 15 is transferred by the transferring roller 16 onto a sheet of copy paper that has been supplied from the paper feed cassette 18 by way of the resist rollers 17. The copy paper bearing the transferred toner image is conveyed by the conveyer belt 28 to the fixing device 30, where the toner image is subjected to heat treatment and fixed. Then, the paper discharge rollers 31 discharges the fixed sheet of copy paper out of the main body 80.

Additionally, a black-and-white copying operation is conducted by: supplying black toner from the black developer tank 9 onto an electostatic latent image formed on the photoreceptor drum 8; and by transferring the toner image onto a sheet of copy paper through the transferring belt 15.

On the other hand, during the above color copying operation, waste toner recovery processes are executed by the respective cleaning sections 19, 22 and 25 so as to remove residual toner on the photoreceptor drum 8, the transferring belt 15 and the transferring roller 16.

The efficiency of the toner image transferring from the photoreceptor drum 8 onto the transferring belt 15 is on the order of 90 to 95%; therefore, a part of toner that has not been consumed during the transferring remains on the surface of the photoreceptor drum 8. The residual toner is scraped off by the cleaning blade **19*a* that is provided in the cleaning section 19, and is stored in the waste toner tray 20**.

Further, the efficiency of the toner image transferring from the transferring belt 15 onto a sheet of copy paper is on the order of 80 to 85%; therefore, a part of toner that has not been consumed during the transferring remains on the transferring belt 15. In addition, besides the residual toner from the toner image corresponding to an original document, toner derived from an unexposed portion, which is not directly transferred onto the sheet of copy paper, also remains on the transferring belt 15. This is because the toner image of the unexposed portion situated before and after the original document is formed on the transferring belt 15 due to the setting of the exposing region. The residual toner is scraped off by the cleaning blade **25*a* that is provided in the cleaning section 25, and is stored in the waste toner tray 26**.

Moreover, when a toner image on the transferring belt 15 is transferred onto a sheet of copy paper by the transferring roller 16, the transferring roller 16 is pressed onto the transferring belt 15 with the sheet of copy paper sandwiched in between and at this time, a portion of the transferring roller 16 may directly come into contact with the transferring belt 15 depending on the size of the sheet of copy paper. In this case, toner on the transferring belt 15 moves and adheres to the transferring roller 16 at the directly contacting portion. Accordingly, the toner adhering to the transferring roller 16, which causes contamination on the back of copy paper if left untreated, is scraped off by the cleaning blade **22*a* that is provided in the cleaning section 22, and is stored in the waste toner tray 23**.

Thus, the waste toner is recovered by the respective cleaning sections 19, 22 and 25, and among the recovery amounts of these sections, that of the cleaning section 25 for collecting the waste toner of the transferring belt 15 is the greatest, since the efficiency of the transferring is low and waste toner, not directly related to the toner image derived from the original document, is also recovered therefrom.

Here, the following description will discuss in detail the structure of a waste toner recovery device having the cleaning sections 19, 22, and 25.

As shown in FIG. 1, the waste toner trays 20, 23 and 26 of the respective cleaning sections 19, 22 and 25 are disposed in parallel with the photoreceptor drum 8 in the copying machine main body 80. The waste toner stored in these waste toner trays 20, 23 and 26 is transported in directions indicated by respective arrows, and conveyed into a waste toner recovery container 34 through waste toner recovery pipes 70, 72 and 74, disposed along the back wall in the copying machine main body 80, and through another waste toner recovery pipe 76 that is disposed in parallel with the photoreceptor 8.

Additionally, when seen from the front of the copying machine main body 80 in FIG. 3, the waste toner recovery container 34 is desirably arranged at a station far away from other consumable components such as the photoreceptor drum 8 and the transferring belt 15 that require periodic maintenance. As such a desirable station, for example, the location above the fixing device 30 at the front of the copying machine main body 80 is recommended. This is because the waste toner recovery container 34 needs to be disposed at the best station where it never interferes with the maintenance of other consumable components such as the photoreceptor drum 8.

The waste toner recovery pipe 76, located at the last portion of the toner flow, has its one end (outlet) connected to the waste toner recovery container 34 and has its other end connected to one end of the waste toner recovery pipe 70. The waste toner recovery pipe 70 is arranged so that the other end is located below the waste toner tray 26. Further, an upright branch 70*a*, which is attached to the waste toner recovery pipe 70 at a portion closer to the other end, is connected to the waste toner tray 26. One end of the waste toner recovery pipe 72 is connected to the upright branch 70*a*, while one end of the waste toner recovery pipe 74 is connected to the waste toner recovery pipe 72 at the middle portion thereof. The waste toner recovery pipe 74 is arranged so that the other end is located below the waste toner tray 20, and an upright branch 74*a*, which is attached to the waste toner recovery pipe 74 at a portion closer to the other end, is connected to the waste toner tray 20.

Here, in this arrangement, the waste toner tray 26, which is provided in the cleaning section 25 having the most waste toner recovery amount, is disposed at the latter portion of a toner flow than the other waste toner trays 20 and 23, while the waste toner recovery container 34 is located at the closest station to the waste toner tray 26 in comparison with the distances to the other waste toner trays 20 and 23.

Referring to FIG. 2, the following description will discuss the internal construction of the waste toner recovery pipe 70 or other components. An auger axis 71 is installed rotatably inside the waste toner recovery pipe 70 that is located at the middle portion of the toner flow. The auger axis 71 is rotatively driven by a drive motor 35 installed at the cleaning section 25 of the transferring belt 15 through the following mechanism: The driving force is transmitted to a gear 65 secured to the upper end of the auger axis 71 by way of a gear mechanism constituted by a timing belt 44 and gears 45 to 48 as well as a gear 66 that is coaxial to the gear 48. Thus, the waste toner inside the waste toner recovery pipe 70 is conveyed in a direction indicated by an arrow in FIG. 2.

An auger axis 73 is installed rotatably inside the waste toner recovery pipe 72 that is located at a portion of the toner flow just before the waste toner recovery pipe 70. Similarly, the auger axis 73 is rotatively driven by the drive motor 35 through the following mechanism: The driving force is transmitted to a gear 42 secured to the upper end of the auger axis 73 from the drive motor 35 by way of a gear mechanism constituted by gears 36 to 40. Thus, the waste toner inside the waste toner recovery pipe 72 is conveyed in a direction indicated by an arrow in FIG. 2. Moreover, the rotation of the auger axis 73 is transmitted through the gear 41, meshed with the gear 40, to an auger axis 27 that is coaxial to the gear 41. Thus, the waste toner recovered by the cleaning section 25 is conveyed toward the waste toner recovery pipe 70 by the rotation of the auger axis 27.

In addition, as to an auger axis 24 that is located in the proximity of the other end of the waste toner recovery pipe 72, it is driven by a drive motor 64 of a driving device (not shown) for use in paper feeding, suction and fixing through the following mechanism: The driving force is transmitted through a gear mechanism constituted by gears 58 to 63, with the gear 58 being coaxial to the auger axis 24. Thus, the waste toner recovered by the cleaning section 22 is conveyed toward the waste toner recovery pipe 72.

An auger axis 75 is installed rotatably inside the waste toner recovery pipe 74 that is located at the first portion of the toner flow. The auger axis 75 is rotatively driven by driving gears 51 and 52 constituting a driving device (not shown) of the photoreceptor drum 8 through the following mechanism: The driving force is transmitted through gears 53 and 55 to an auger axis 21, which is coaxial to the gear 55, and a gear 56, and then transmitted to a gear 57 engaged by the gear 56, which is secured to the top end of the auger axis 75. Thus, the waste toner inside the waste toner recovery pipe 74 is conveyed in a direction indicated by an arrow in FIG. 2. On the other hand, the waste toner recovered by the cleaning section 19 is conveyed by the auger axis 21 toward the waste toner recovery pipe 74.

Lastly, an auger axis 33 is installed rotatably inside the waste toner recovery pipe 76 that is located at the last portion of the toner flow. The auger axis 33 is driven through a gear 49 that is engaged by the gear 48 used for driving the aforementioned auger axis 71.

As described above, in the present embodiment, the auger axes for conveying waste toner do not require any exclusive-use driving devices. Moreover, as shown in FIG. 1, the transport path constituted by the waste toner recovery pipes 70, 72, 74 and 76 are successively directed to the waste toner recovery container 34 by way of the waste toner trays 20, 23 and 26. Therefore, the waste toner stored in those waste toner trays 20, 23 and 26 is successively conveyed through the waste toner recovery pipes 70, 72, 74 and 76, and eventually collected into the waste toner recovery container 34 that is attached to the exit of the transport path.

In other words, the waste toner accumulating in the waste toner tray 20 is conveyed into the waste toner recovery pipe 72 through the waste toner recovery pipe 74, and joins the waste toner accumulating in the waste toner tray 23 on the way while being conveyed inside the waste toner recovery pipe 72 in a direction indicated by arrows. Thereafter, the waste toner of the waste toner trays 20 and 23 joins the waste toner accumulated in the waste toner tray 26 at the upright branch 70*a* of the waste toner recovery pipe 70. After having been conveyed through the waste toner recovery pipes 70 and 76 in a direction indicated by arrows, the joint waste toner is then stored in the waste toner recovery container 34.

As described above, the waste toner recovery device of the present embodiment is arranged such that the waste toner respectively remaining or accumulating at the photoreceptor drum 8, the transferring belt 15 and the transferring roller 16 is collected by the respective cleaning sections 19, 22 and 25, and then stored in the waste toner recovery container 34 in one lot through the waste toner recovery pipes 70, 72, 74 and 76. Thus, in the waste toner recovery device, recovery of the waste toner in maintenance can be performed simply by exchanging the waste toner recovery container 34 only at one place; and more space can be saved inside the copying machine main body 80 (especially at the front). These advantages make it possible to improve the efficiency of the maintenance work.

Moreover, in the present embodiment, the auger axes 21, 24 and 27 are installed in the cleaning sections 19, 22 and 25 while the auger axes 71, 73, 75 and 33 are installed in the waste toner recovery pipes 70, 72, 74 and 76; this arrangement makes it possible to forcibly transport the waste toner inside the waste toner recovery pipes 70, 72, 74 and 76. Therefore, compared with a system for recovering the waste toner into the waste toner recovery container 34 by letting it fall by gravity, the mounting place of the waste toner recovery container 34 can be more freely selected. This free selection makes it possible to install the waste toner recovery container 34 at the best place, far away from the photoreceptor drum 8, etc. so as not to interfere with the maintenance work; thus, the efficiency of the maintenance work can be fully improved.

Furthermore, in the present embodiment, the cleaning section 25 having the most waste toner recovery amount is disposed at the latter portion of the waste toner flow than the other cleaning sections 19 and 22 such that it is located closest to the waste toner recovery container 34. That is, the transport distance from the cleaning section 25 having the most waste toner recovery amount (conveying amount) to the waste toner recovery container 34 is set to be the shortest. Consequently, since the weight and resistance of the waste toner respectively accumulating in the waste toner recovery pipes 70, 72, 74 and 76 are restricted, loads imposed on the auger axes 71, 73, 75 and 33 can be reduced. Additionally, in order to reduce the loads most effectively, the transport distances are preferably shortened in the ascending order of their recovery volumes of the waste toner.

Such reduction of the loads allows reduction of toner clogging inside the waste toner recovery pipes 70, 72, 74 and 76 as well as ensures long life of the driving system by reducing wear on the driving system. Furthermore, such reduction of the loads makes it easier to employ driving forces from other driving sources, and thus obviates the necessity of individual driving sources and exclusive-use driving devices for driving the auger axes 21, 23, 73 and 75. With these advantages, the waste toner recovery device achieves efficient recovery of a large amount of the waste toner.

Additionally, in the above embodiment, an explanation has been given of the waste toner recovery device which is employed in a full-color copying machine equipped with the photoreceptor drum 8; yet the device is also applicable to common image forming apparatuses equipped with a photoreceptor belt. Moreover, in the present embodiment, in order to explain the fine particle recovery device of the present invention, the waste toner recovery device is discussed as one example, which recovers waste toner accumulating at a plurality of locations. However, not limited to this application, as long as it is used for recovering fine particles accumulating at a plurality of locations to store in one place, the fine particle recovery device may be any device, such as used for recovering spent developer in the developer tanks 9 through 12 as fine particles. Moreover, the fine particle recovery device may be a device for recovering both the waste toner and the spent developer; this application results in a further improved efficiency of the maintenance work.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fine particle recovery device for recovering fine particles accumulating at a plurality of locations in an image forming apparatus, comprising:

transport path means for passing the fine particles accumulating at the respective locations, the transport path means extending horizontally by all the locations containing the fine particles and the transport path means sequentially receiving the fine particles from all of the respective locations, the fine particles being cumulatively added to the transport path means from the respective locations, the transport path means moving the fine particles in a plurality of directions;

recovery means for storing the fine particles in one lot, the recovery means being disposed at an exit of the transport path means; and conveying means for conveying the fine particles toward the recovery means, the conveying means being installed in the transport path means and conveying the fine particles upwardly before depositing the fine particles in the recovery means.

2. The fine particle recovery device as set forth in claim 1, wherein the conveying means comprises a conveying member such that the fine particles are conveyed by rotational motion of the conveying member.

3. The fine particle recovery device as set forth in claim 2, wherein the conveying member is constituted by a rotation axis having a helical blade formed therearound.

4. The fine particle recovery device as set forth in claim 2, wherein the conveying member is rotatively driven by a driving force that is supplied by a driving source of the image forming apparatus.

5. The fine particle recovery device as set forth in claim 2, wherein the conveying member is rotatively driven by a driving force that is supplied by a driving source of the image forming apparatus, the driving force being transmitted to the conveying means by means of a gear mechanism.

6. The fine particle recovery device as set forth in claim 1, wherein the fine particles are waste toner.

7. The fine particle recovery device as set forth in claim 1, wherein the fine particles are spent developer.

8. The fine particle recovery device as set forth in claim 1, wherein the fine particles are waste toner and spent developer.

9. The fine particle recovery device as set forth in claim 1, wherein the transport path means are constituted by pipes.

10. The fine particle recovery device as set forth in claim 1 which is use in a full color copying machine.

11. The fine particle recovery device as set forth in claim 1, wherein the image forming apparatus comprises a photoreceptor drum, a transferring belt and a transferring roller from which fine particles are recovered, the transport path means comprises toner trays extending along each of the photoreceptor drum, the transferring belt and the transferring roller, the conveying means comprises auger conveyors in each of the toner trays, the auger conveyors conveying the fine particles within the toner trays to a discharge end of the toner trays, the transport path means further comprises toner recovery pipes extending from the discharge ends of the toner trays to the recovery means, one of the toner recovery pipes being upwardly inclined, the conveying means further comprises an auger conveyor in the one upwardly inclined toner recovery pipe, all of the fine particles being conveyed upwardly through the one inclined toner recovery pipe before reaching the recovery means.

12. A fine particle recovery device for recovering fine particles accumulating at a plurality of locations in an image forming apparatus, comprising:

transport path means for passing the fine particles accumulating at the respective locations, the transport path means extending sequentially by all the locations containing the fine particles to thereby sequentially receive the fine particles, the fine particles being cumulatively added to the transport path means from the respective locations;

recovery means for storing the fine particles in one lot, the recovery means being disposed at an exit of the transport path means;

conveying means for conveying the fine particles toward the recovery means, the conveying means being installed in the transport path means; and consumable members for which periodic maintenance is required, the consumable members comprise a photoreceptor drum, a transferring belt and a transferring roller from which fine particles are recovered, wherein the recovery means is mounted at such a station that no disturbance is caused thereby during the periodic maintenance, the transport path means comprises toner trays extending along each of the photoreceptor drum, the transferring belt and the transferring roller, the conveying means comprises auger conveyors in each of the toner trays, the auger conveyors conveying the fine particles within the toner trays to a discharge end of the toner trays, the transport path means further comprises toner recovery pipes extending from the discharge ends of the toner trays to the recovery means, one of the toner recovery pipes being upwardly inclined, the conveying means further comprises an auger conveyor in the one upwardly inclined toner recovery pipes, all of the fine particles being conveyed upwardly through the one inclined toner recovery pipe before reaching the recovery means, the auger conveyor in the one upwardly inclined toner recovery pipe conveys fine particles away from the consumable members.

13. The fine particle recovery device as set forth in claim 12, wherein the mounting station of the recovery means is located far from the consumable members, when seen from the front of the image forming apparatus.

14. The fine particle recovery device as set forth in claim 12, wherein the mounting station of the recovery means is located above a fixing device at the front of the image forming apparatus.

15. A fine particle recovery device for recovering fine particles accumulating at a plurality of locations in an image forming apparatus, comprising:

transport path means for passing the fine particles accumulating at the respective locations, the transport path means extending sequentially by all the locations containing the fine particles to thereby sequentially receive the fine particles, the fine particles being cumulatively added to the transport path means from the respective locations;

recovery means for storing the fine particles in one lot, the recovery means being disposed at an exit of the transport path means; and conveying means for conveying the fine particles toward the recovery means, the conveying means being installed in the transport path means, wherein, among transport distances from the respective locations to the recovery means, the transport distance from the location having the most conveying amount of the fine particles to the recovery means is set to be the shortest, the image forming apparatus comprises a photoreceptor drum, a transferring belt and a transferring roller, from which waste toner is recovered, a transport distance of waste toner from the transferring belt to the recovery means is set to be the shortest.

16. The fine particle recovery device as set forth in claim 15, wherein the transport distances from the respective locations to the recovery means are set to be shortened in the ascending order of the respective fine-particle conveying volumes.

17. The fine particle recovery device as set forth in claim 15, wherein the transport path means comprises toner trays extending along each of the photoreceptor drum, the transferring belt and the transferring roller, the conveying means conveys the waste toner within the toner trays to a discharge end of the toner trays, the transport path means further comprises toner recovery pipes, a first toner recovery pipe extending from the toner tray along the photoreceptor drum to a second toner recovery pipe, the discharge end of the toner tray along the transferring roller feeding the waste toner to the second toner recovery pipe, the conveying means feeding the waste toner from the second recovery pipe to a third recovery pipe, the discharge end of the toner tray along the transferring belt feeding the waste toner to the third recovery pipe, the conveying means feeding the waste toner in the third recovery pipe upwardly to a fourth recovery pipe, the conveying means further conveying the waste toner along the fourth recovery pipe from the third recovery pipe to the recovery means, all of the waste toner being conveyed through the third and fourth recovery pipes, the toner tray along the transferring belt having the most conveying amount of the waste toner and being the shortest conveying distance to the recovery means.

* * * * *